United States Patent [19]

Jenn

[11] Patent Number: 4,800,692

[45] Date of Patent: Jan. 31, 1989

[54] CRUCIFORM DWELLING STRUCTURE

[75] Inventor: Louis J. Jenn, Indianapolis, Ind.

[73] Assignee: Atrium Structure, Inc., Indianapolis, Ind.

[21] Appl. No.: 148,177

[22] Filed: Jan. 25, 1988

Related U.S. Application Data

[63] Continuation of Ser. No. 906,124, Sep. 22, 1986, abandoned.

[51] Int. Cl.[4] ..... E02D 1/00

[52] U.S. Cl. ..... 52/169.2; 52/169.3

[58] Field of Search ..... 52/169.1, 169.2, 169.3, 52/234

[56] References Cited

U.S. PATENT DOCUMENTS

| | | | |
|---|---|---|---|
| 3,839,833 | 10/1974 | Steele | 52/234 X |
| 4,007,565 | 2/1977 | Finnegan | 52/169.3 |
| 4,232,490 | 11/1980 | Doane | 52/234 X |
| 4,345,407 | 8/1982 | Fishman | 52/234 X |

FOREIGN PATENT DOCUMENTS

| | | | |
|---|---|---|---|
| 814522 | 7/1951 | Fed. Rep. of Germany | 52/169.3 |

*Primary Examiner*—Carl D. Friedman

*Assistant Examiner*—Creighton Smith

*Attorney, Agent, or Firm*—Woodard, Emhardt, Naughton, Moriarty & McNett

[57] ABSTRACT

A multi-family dwelling for provding privacy, security and improved land utilization includes a series of eight individual living units configured into a dual-cruciform structure wherein each living unit shares a common dividing wall on one side with a contiguous living unit and perpendicular thereto shares another dividing wall with a different contiguous unit. Each living unit has its own private and enclosed atrium courtyard as well as its own private and remotely located garage. The common dividing walls are substantially perpendicular to each other and the layout of each living unit in combination with its garage and atrium courtyard is substantially identical, though mirror images so as to enable each cruciform structure to be positioned at the approximate center of its correspondig lot. Each living unit is connected to its corresponding garage by a first wall section which includes a security gate and by a second, separate wall section which is disposed substantially perpendicular to the first wall section. The security gate and the garage each communicate with a corresponding city street by means of a walkway and driveway.

9 Claims, 3 Drawing Sheets

CRUCIFORM DWELLING STRUCTURE

This application is a continuation, of application Ser. No. 906,124, filed 9/22/86, now abandoned.

BACKGROUND OF THE INVENTION

The Present invention relates in general to multiple-family dwellings with a form of construction that yields enhanced security and more efficient land use. More particularly, the present invention relates to a double-cruciform structure having longitudinally and laterally extending dividing walls which define eight L-shaped dwelling portions, each dwelling portion having a private atrium courtyard and each courtyard being surrounded and enclosed for privacy and security.

Convention residential housing represents highly inefficient use of land and an exposure of property that invites vandalism, burglary and theft. By placing the house in the approximate center of a lot, the surrounding land is unable to be used as a complement for the structure except for plantings and to establish spacing from adjacent property owners. This approach leaves all sides of the house exposed and the view out of any window or door is typically limited to a small portion of the owner's own property and the neighbor's land and house. With smaller lots, a property owner's view is often dominated by someone else's property, the streets and traffic.

Since the perimeter of conventional residential housing is exposed, numerous opportunities exist for a break-in or vandalism. If the owner is home at the time, there is still a substantial risk due to the way that houses are configured and set on their corresponding lots. Further, looking out of a window does not necessarily enable a property owner to see or check the status of other portions of the house exterior. Conventional housing also represents an inefficient use of land because the traditional approach does not enable multiple-family housing within the same structure and excessive land is used for the surrounding yard.

Concerns over household crime, vandalism and burglary are neither minor nor easily ignored. As might be expected, burglary and robbery in urban areas is higher than in rural areas. The extent of the difference though may not be expected. Crimes of this type in urban areas exceed those in rural areas by a factor of almost 5 to 1 as reported by Scripps Howard News Service (*Indianapolis Star,* June 30, 1986). Theft in households of $25,000 or more is almost twice that of households with incomes less than $7,500. With the new emphasis on downtown and inner city renovation in many major cities and the desire of single people and professionals to be closer to their work, a significant premium is placed on downtown and inner city property. If the property is used for offices, high-rises are usually the result due to the efficient use of the land. However, if somewhat conventional residential units are to be built, unit density may not be the primary concern. A balance needs to be found between the compact, high-density approach of apartments and the less-efficient land use of the traditional residence.

The present invention offers that balance by a construction approach that easily doubles the population density of a "normal" city block while providing enhanced security, privacy and a private atrium courtyard for each family or occupant. The present invention is particularly well suited for renovation of a full city block, but can as well be used for new construction in either urban or rural areas. The "single-wide" approach of the present invention enables conventional stick-built construction or preconstructed housing modules which are moved on-site for the final, permanent attachment and finishing. Although the present invention is believed to provide the optimum balance between various factors and constraints, there have been earlier attempts to address some of the concerns solved by the present invention.

One approach to a more efficient use of land is provided by my earlier U.S. Pat. No. 3,629,983 which issued Dec. 20, 1971. By the disclosed quadrangle atrium concept, a common atrium is defined and enclosed by four individual dwelling units which are permanently attached together. A single atrium is shared by all the occupants of the four units. The enclosing nature of the dwelling units provides privacy for the use of the atrium and a desirable land use efficiency. However, the units are individually constructed and joined together and the exterior of each unit, configured with conventional doors and windows, remains exposed. Further, the view out of one occupant's unit is limited to either the street, a parking lot, or someone else's property, or alternatively, of the atrium and the dwelling units of the other three occupants. Further, the exposed exterior of each unit provides but a single barrier against intrusion.

A related approach which provides a shared or common patio or courtyard is found in the Panitz U.S. Pat. No. 3,678,639 which issued July 25, 1972. Panitz though discloses a mobile home arrangement wherein two or more mobile homes are arranged in order to give the appearance of a single conventional dwelling and the arrangement incorporates vertical walls which ar located at each end of the mobile homes and inbetween the two homes with the intent to give the combined homes an attractive appearance of a permanent conventional dwelling.

Since my earlier U.S. patent involved preconstructed housing, many of the prior references which I am aware of are directed to the assembly and arrangement of trailers, single-wide units, and related housing concepts. Disclosed by some of the following references are concepts for arranging the dwelling units relative to one another. Regardless of the particular details though, certain design deficiencies remain. In most cases the exterior of each unit is exposed and there is only a single barrier against intrusion. For example, Brown (U.S. Pat. No. 3,609,929 issued Oct. 5, 1971); Koger (U.S. Pat. No. 1,156,693 issued Oct. 12, 1915); and Whelan (U.S. Pat. No. 2,154,142 issued Apr. 11, 1939) each disclose concepts for joining two single-wide units together. Each unit begins as a partially preconstructed unit and final assembly is completed on site. As is evident from a review of these three references, the windows and doors remain exposed around the entire outer periphery of the completed assembly. The aforementioned concerns of privacy and security are not solved by the approaches adopted by Brown, Koger and Whelan. Other joining and arranging techniques are disclosed by Delk (U.S. Pat. No. 4,258,512 issued Mar. 31, 1981); Renauld (U.S. Pat. No. 3,640,037 issued Feb. 8, 1972); Van der Lely (U.S. Pat. Nos. 3,254,458; and 3,292,327 issued June 7, 1966 and Dec. 20, 1966, respectively). In these four references, the individual units are kept as single-family individual units, and the focus of each patent is on how to configure a plurality of such units into a layout or trailer park design. Once again, the aforementioned concerns of security, privacy, economy and efficient land use are not addressed by these references.

While many of the foregoing references are directed to multiple-family arrangements, some housing approaches have dealt with single-family units which are arranged to create a private patio or atrium area and with ways to segregate one piece of property from the adjacent lots. For example, in Coxe, U.S. Pat. No. 3,996,709 issued Dec. 14, 1976, individual housing units are arranged to define a patio (though not enclosed) which is separated from the adjacent property by a separating wall. One portion of each separating wall abuts up against a contiguous housing unit end. These walls are not integral with the individual units and in that sense not shared. Further, the doors and windows of each unit are exposed throughout the periphery of each unit and the separating walls are neither surrounding nor enclosing. In Schmitt, U.S. Pat. No. 3,894,369 issued July 15, 1975, we see a single-family dwelling that has its periphery exposed and is apparently set in the center of a lot. The arrangement which includes an outdoor patio 2, provides only a single security barrier. Although the patio is not shared and thus offers greater privacy, the remainder of the dwelling is unusual in that there are no exterior windows except for the glass portions 4 which may be opened. While security may be enhanced by reducing the number of exposed windows and doors, there is still only a single barrier against intrusion and nothing has been done to more efficiently utilize the land nor has anything been done to reduce construction costs by configuring the concept of Schmitt into multiple-family units.

Another singular patio approach without the benefit of building multiple-family units is disclosed by Gentry, U.S. Pat. No. 3,874,137, issued Apr. 1, 1975. As illustrated in FIG. 1 of Gentry, a series of individual dwelling units, separate and distinct from each other, are arranged so that each one defines a Private patio which is separated from the contiguous dwelling units of other property owners by solid side walls 57 and rear walls 59. Each dwelling unit is configured with its own separate and distinct pair of walls such that a rear wall corresponding to one unit is contiguous to but separate from the rear wall of the backing unit. The construction of these separate and distinct side and rear walls is inefficient, but this must be done in the manner disclosed since each dwelling unit is separate and distinct and not of a common design. Further, there is no indication that the illustrated units as set on their individual lots are built at the same time. Consequently, in view of the time stagger and in view of the varying layout design, the walls for the unit cannot be built until the unit is designed and set in place on its corresponding lot.

The final group of references which I am aware of does not appear to be particularly relevant to the present invention. However, these references appear to disclose, in two instances, construction concepts for residential units. These two references are French Patent No. 981.058 issued to Petit, and French Patent No. 920.354 issued to Arnould. The final reference is defensive publication under the name Ferwerda, publication number T964,001 which issued Nov. 1, 1977. This publication discloses a technique to secure or anchor members together.

It is clear that none of the foregoing references address all of the concerns which are addressed by the present invention, nor do these prior references either singularly or in combination anticipate or render obvious the present invention.

No one should argue that a conventional, stick-built, single-family dwelling, which is located in the approximate center of a lot, represents an inefficiency of land use and a costly construction approach. Multiple-family dwellings such as apartments represent a more efficient land use based on the square footage of living space relative to the land area occupied. Due to the scarcity and cost of land in certain areas, apartments have often been the only cost-effective approach. Apartment living though is not without its share of drawbacks. Privacy and security are concerns as well as the loss of a yard and/or patio. Until the present invention, a compromise between a traditional single-family approach and apartment living has not been disclosed nor suggested. The present invention is particularlly well suited for inner city, city block renewal projects.

Consider a typical city block arranged with 20 homes and lots, side by side and back to back in a $2 \times 10$ array. For inner city neighborhoods, the lot size of 60 feet by 100 feet is reasonable. If the house which is placed on that lot measures, by its outside dimensions, 30 feet by 40 feet, there are 1,200 square feet of residential space and a resulting 4,800 square feet of unutilized yard. With the house set in or near the middle of the lot, the 4,800 square feet of yard is arranged as a surrounding border approximately 15 feet wide on the sides and having an approximate 30-foot spacing front and rear. A garage may occupy some of this yard space, but otherwise, it is wasted land except for various plantings. This type of house and yard configuration offers neither privacy nor security.

By the present invention a "zero lot line" approach is used wherein the house is arranged as a U- or L-shaped structure and its outer walls are placed directly on the property line edge. With security walls disposed on the remaining property line edges except for the street side where the house and walls ar recessed from the property line, an atrium courtyard is defined on the interior and it is completely enclosed. While this approach still provides the same square footage of living space, the lot size can be cut in half. The homeowner still has a yard (atrium) and greatly enhanced security and privacy. The outer security wall provides double barrier against intrusion such that penetration through this outer wall does not enable access to the property and possessions of the occupant.

A further improvement offered by the present invention is the ability to accomplish the foregoing while building multiple-family, single structures. This is able to be done by using a dual-cruciform technique where one cruciform configured structure is centered at the interior, common corner of four contiguous lots. This particular dual-cruciform configuration will be disclosed in greater detail hereinafter. One advantage of this approach with the "zero lot line" concept is that adjacent units can be placed contiguous to each other and share a common dividing wall. This precludes the need for a separate security wall at that location without sacrificing privacy on security.

Each of the features of the present invention will be developed and disclosed more fully, and as the description of the present invention evolves, its improvements over the prior references and its substantial differences from those prior references will become more apparent.

SUMMARY OF THE INVENTION

A multi-family dwelling as disposed on a lot according to one embodiment of the present invention comprises a plurality of living units wherein each unit is configured into an L-shaped structure and oriented so as to define two edges of a corresponding private atrium courtyard, a first dividing wall which is common to each of the plurality of living units, a second dividing wall which is common to each of the plurality of living units and which is generally perpendicular to the first dividing wall and security means associated with each living unit for completing the enclosing of each private atrium courtyard.

One object of the present invention is to provide an improved multi-family dwelling which is arranged with a plurality of individual living units, each of which has its private atrium courtyard.

Related objects and advantages of the present invention will be apparent from the following description.

DESCRIPTION OF THE PREFERRED EMBODIMENT

Figure 1:
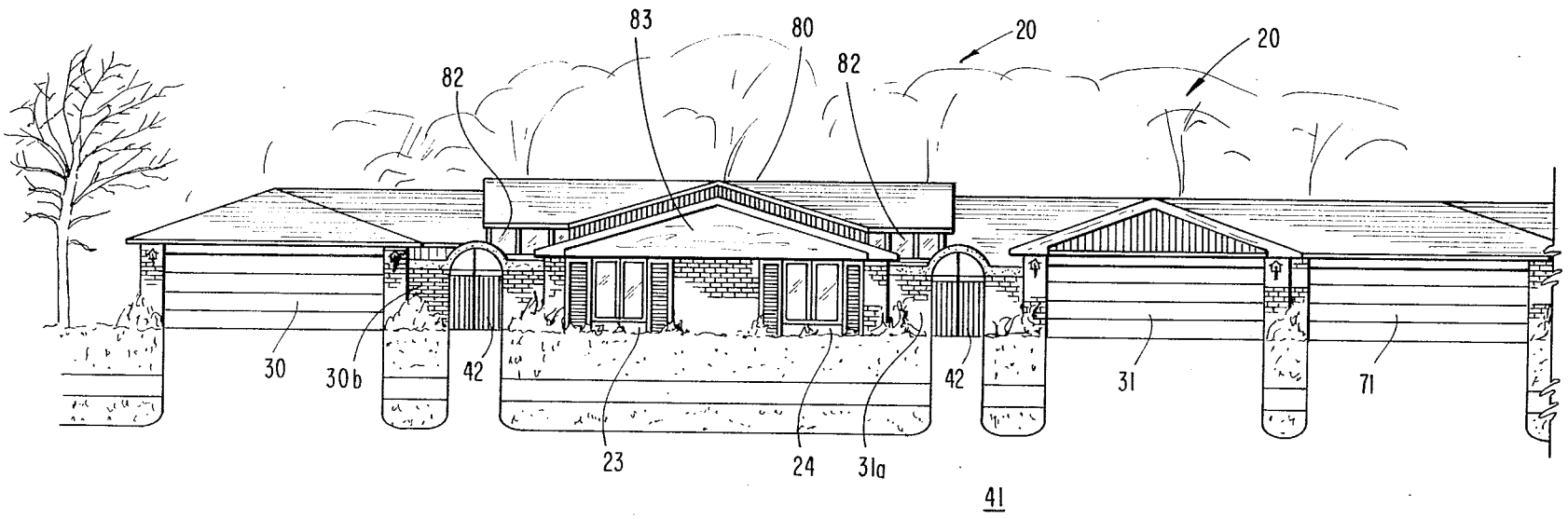
FIG. 1 is a front elevation view of a mult-family dwelling according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
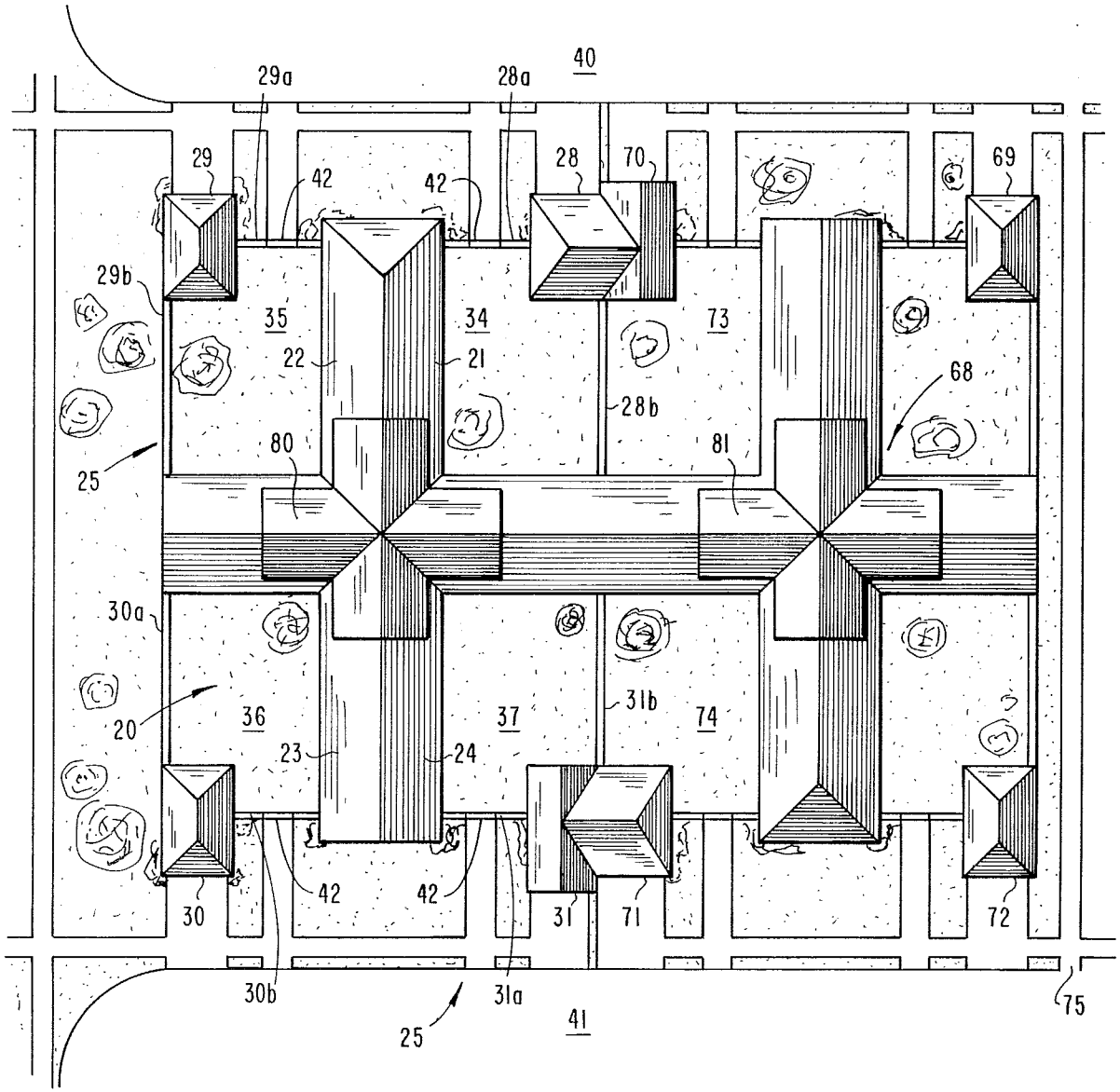
FIG. 2 is a top plan view of the FIG. 1 multi-family dwelling.

Referring to FIGS. 1 and 2, there is illustrated a multi-family dwelling 20 which includes four individual living units 21, 22, 23 and 24 which are arranged into a cruciform shape. The approximate center of the cruciform shape is disposed at the approximate center of lot 25.

Each of the four living units 21–24 is configured as a generally L-shaped structure and associated with each living unit is a detached and remotely located storage unit 28, 29, 30 and 31. Extending between each storage unit and its corresponding living unit is a pair of wall sections 28*a*, 28*b*, 29*a*, 29*b*, 30*a*, 30*b*, 31*a* and 31*b*.

Each of the four living units has its own private atrium courtyard 34, 35, 36 and 37. As is to be understood from the FIG. 2 illustration, each of the four living units has a pair of exterior walls which define two edges of its corresponding atrium courtyard. These two exterior walls also coincide with the interior edges of the L-shaped structure. One such wall defines a length dimension to the generally rectangular corresponding atrium and the other wall of the living unit coincides with the width dimension of the corresponding atrium. The remaining length and width of each atrium courtyard is coincident with the corresponding wall sections.

In the case of living unit 21, wall sections 28*a* and 28*b* are disposed on the opposite width and length edges of the atrium courtyard, respectively. The final enclosing of each atrium courtyard is achieved by the corresponding storage unit. Each storage unit is placed at a corner of its corresponding atrium courtyard with a portion of that storage unit extending into the interior of the atrium courtyard and a portion extending outwardly in the direction of a city street or road with which the storage unit communicates by means of a driveway.

This particular arrangement of wall sections, living unit and storage unit is virtually identical in each of the four quadrants of lot 25. Although each of the quadrants vary as to whether they are upper or lower or left-hand or right-hand, this is all determined by the orientation of the generally L-shaped living units.

As is best illustrated by FIG. 2, the multi-family dwelling 20 is disposed between two substantially parallel running streets 40 and 41. Communicating with these two streets are driveways and walkways, one each for each of the living units. In this particular arrangement, the present invention is intended to represent the modification and renovation of a city block wherein the typical lot sizes are reduced and space utilization efficiency increased as previously mentioned in the background discussion. In order to provide all of the basic expectations of residential living, each of the four living units which are arranged into the cruciform shape are provided with a garage, a driveway and sidewalk access from the street. One difference though is that the ends of each living unit which face the corresponding street do not include either doors or windows. Consequently, there is no risk of break-in or burglary through that portion of the living unit and this is the only location where there is but a single barrier, but a barrier without any realistic means of penetrating since there are no doors or windows.

In order to gain access to the interior of the various living units, it is required for an individual to first either enter the garage (or storage area) and then pass through the atrium courtyard and break into a second barrier of protection, the actual living unit. If a robber or burglar or vandal would elect to try and enter the atrium courtyard without passing through the garage, then an outer security wall must be scaled or a high iron gate 42 which is disposed in one wall section must be broken through. Although one could gain access to the atrium area by scaling the wall, that represents a very difficult task and one which is not at all suitable if robbery is the motive due to the inability to remove heavy or bulky goods from the living unit.

The only windows or doors which exist as part of the individual living units are disposed along the atrium-facing walls such that when the occupants look out from their individual living units, their view is not obstructed by the property of others. When one looks out of his or her own living unit the view is of the various security walls, the storage unit or garage, but more importantly his own atrium area. It is also possible to view the corresponding, opposite wing of each L-shaped living unit. The presence of the outer wall creates a double barrier of protection and by taking appropriate steps to equip the garage, the exterior iron gate 42 and the security walls with an alarm system, the occupants of the living units receive an early-warning indication of any break-in attempt or any tampering with the outer barrier. This early warning gives the occupants time to either call police or secure themselves and their belongings prior to harm or injury.

A further option with an alarm system tied into the outer walls and garage is the ability for that alarm system to automatically turn on both lights within the living units and flood lights throughout the atrium area. Consequently, if a robber or vandal would attempt to break through the gate, tamper with the locks on the gate or garage or attempt to break into the garage in order to gain access to the living unit, lights would immediately be turned on and the occupants of the living units would be alerted. This particular feature in combination with the double barrier provided by the outer security walls creates an extremely private and secure residence. Further, the individual, private atrium courtyard gives the occupants of each living unit a yard area for enjoyment, plantings and entertainment. This area is also desirable for young children since they cannot get out into the street, wander away, and they are always visble to the parents from inside the corresponding living unit.

Figure 3:
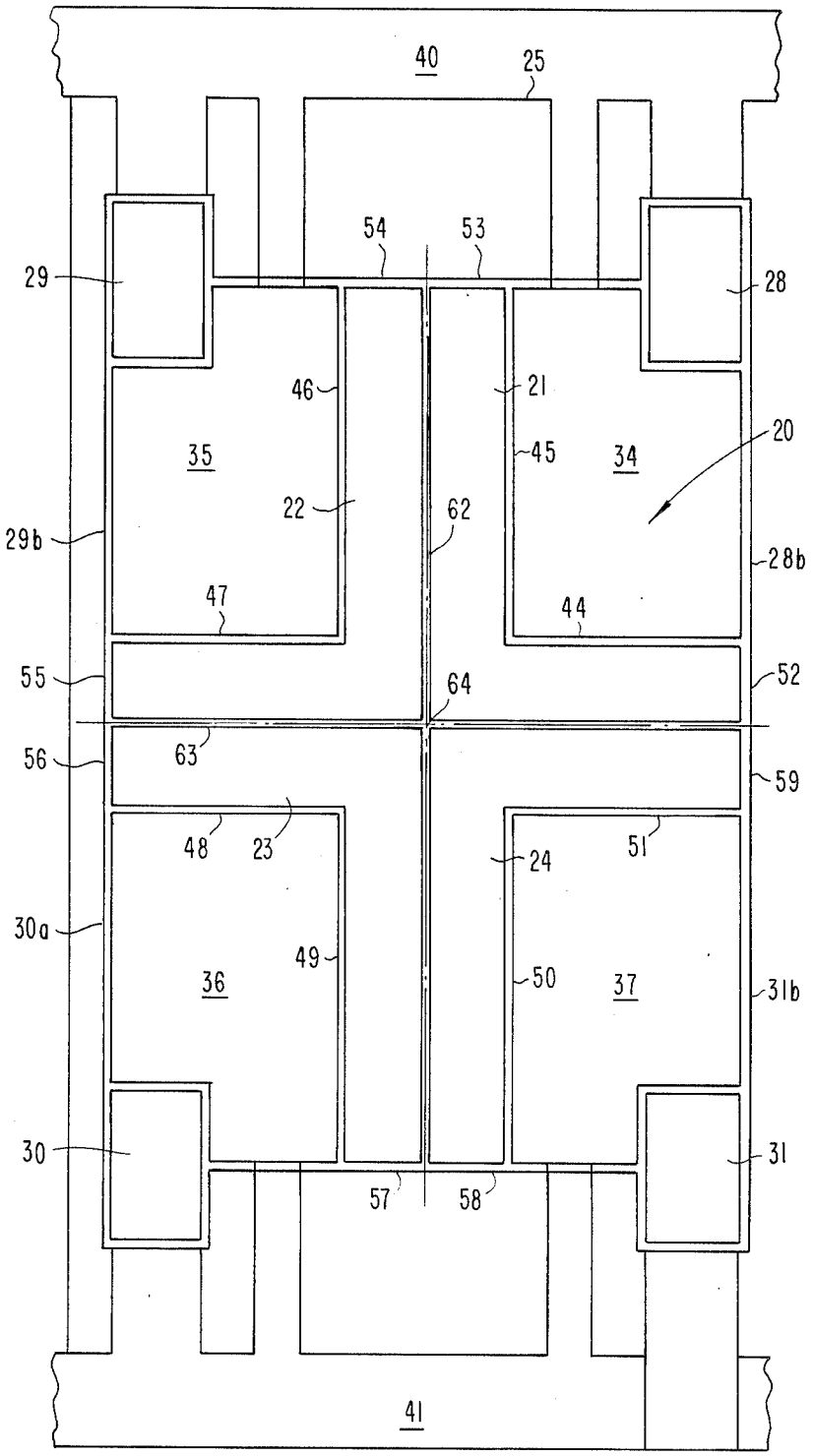
FIG. 3 is a top plan diagrammatic view of the FIG. 1 multi-family dwelling as disposed on a corresponding lot.

Referring to FIG. 3, there is a diagrammatic top plan view of multi-family dwelling 20 showing the interior configuration and the presence of common walls which are shared by the four living units. FIG. 3 has been limited to only an illustration of lot 25 which extends from street 40 to street 41 and includes only one cruciform structure. However, the actual construction approach is to provide a dual-cruciform structure wherein the second cruciform structure is an inverted mirror image of the first. Each living unit 21–24 includes a pair of substantially perpendicular atrium-facing walls 44, 45, 46, 47, 48, 49, 50 and 51. Each living unit also includes a corresponding pair of end walls 52, 53, 54, 55, 56, 57, 58 and 59. While end walls 53, 54, 57 and 58 face outwardly toward their corresponding streets, end walls 55 and 56 are substantially coincident with enclosing security walls **29*b* and 30*a*. End walls 59 and 52** are actually common to the contiguous, second cruciform structure.

The cruciform shape of multi-family dwelling 20 incorporates a pair of dividing walls 62 and 63. Dividing wall 62 is an interior structural wall of both living unit 21 and living unit 22. Depending on the particular construction technique employed, an extension of wall 62 may also be the common dividing wall between living units 23 and 24. Likewise, dividng wall 63 is common to living units 22 and 23 and another portion or extension of wall 63 is also common to living units 21 and 24. Dividing walls 62 and 63 are substantially perpendicular to each other and their point of intersection 64 is located at the approximate geometric center of lot 25. As intended to be illustrated, lot 25 is actually divided into four individual lots each including a storage unit, a living unit and a atrium courtyard. It is also intended that the four individual lots which comprise larger lot 25 are virtually identical in shape and dimension. Similarly, each of the storage units are substantially identical in size and shape as are the courtyard areas and the corresponding living units. By utilizing common dividing walls 62 and 63 a part of the construction concept for living units 21, 22, 23 and 24, substantial efficiency and ease of construction is realized. While the particular construction technique of utilizing common walls is well known as part of apartment construction, that concept has not been utilized for individual family units each having their own individual atrium courtyard and each having their own individual outer security wall.

Due to the ability to condense the number of residential units for a given lot size without sacrificing the presence of a yard, privacy, security and the same number of square feet of living space in each unit, the present invention offers an extremely attractive option for downtown and inner-city renovation.

As is best illustrated in FIG. 2, a pair of cruciform-shaped dwellings have been arranged in a side-by-side manner. While multi-family dwelling 68 is intended to be configured in a virtually identical manner to dwelling 20, one slight variation can be seen. This variation involves the roof configuration of the storage units or garages which are contiguous to wall **28*b*, and to wall 31*b*. As is illustrated in FIG. 2, the roof configuration of garages 69 and 72 are virtually identical to garages 29 and 30. Similarly, garage 70's roof style is the same as garage 31 while garage 71 is the same as garage 28. Although there appears to be a reversal in configuration on opposite sides of security walls 28*b* and 31*b*, it should be understood that the view from street 41 will be identical to the view from street 40. Consequently, the left and right-hand reversal as to garage roof designs along the centerline between the two dwellings 20 and 68 actually results in an identical view taken from the corresponding streets. It is also important to note that while security walls 28*b* and 31*b* are common to the adjacent atriums 34 and 73, and 37 and 74, respectively, end walls 52 and 59 are also common to the corresponding end walls of dwelling 68**.

Although this dual-cruciform arrangement of eight individual living units could be continued for the full length of the city block, communication between streets 40 and 41 has been provided by means of walkway 75. Walkway 75 is believed to be important due to the inability to pass from one back yard to another as might otherwise be done in a conventionally laid-out city block. By the present configuration of living units, there really does not exist what we typically think of as a back yard and the only means for an occupant of one living unit to visit with the occupant of another living unit in the same city block is to go out of the corresponding security gate in wall **28*a*, for example, and walk around to the security gate entrance of the unit which is to be visited. If the unit to be visited is on hhe opposite street, and if walkway 75 was not provided, a significant distance might have to be traversed. Consequently, walkway 75** merely provides a shortcut from one street to the other.

A final feature which is illustrated in FIGS. 1 and 2 is the presence of a raised roof portion 80 on dwelling 20 and 81 on dwelling 68. This raised roof portion is also of a cruciform configuration and its four portions which meet at the approximate center of the cruciform-shaped dwelling are virtually identical and symmetrical with regard to their corresponding living units. As is illustrated in FIG. 1, these raised roof portions provide for vertical skylights 82, which are outwardly facing toward the corresponding street Although FIG. 1 only illustrates those vertical skylights as directed toward street 41, a similar series are symmetrically located on the opposite side facing street 40. A further benefit of the two raised roof portions 80 and 81 is that they yield a more attractive roofline to the overall structure as is evident from the FIG. 1 illustration. The generally triangular living unit end or gable 83 would have a different appearance and a lower profile if there was not the raised roof portion behind it. Further, the various skylights 82 provide an enhanced vertical profile and depth to the structure giving it improved aesthetics and the appearance of conventional housing.

Although the present invention has been arranged so as to actually recess the living unit and atrium back from the street so as to have the appearance of a somewhat traditional front yard with sidewalks and front walkways, it is conceivable, so long as local ordinances, easements and regulations permit, to move the street-facing security wall, the garage and the living unit toward the street thereby increasing both the area of the atrium courtyard and the square footage available for the living unit. Other envisioned variations to the present invention are to eliminate the storage unit or garage and simply enclose the atrium by a generally L-shaped outer security wall. Although this is a variation, it is believed that the preferred embodiment will include a garage or storage area since society today is automobile-dependent. Further variations include altering the L-shaped arrangement of each living unit into a U-shape or a J-shape. However, either of these two shapes would reduce the atrium courtyard and the added square footage for the living space which would be provided is not believed to be necessary in view of the adequate living space which can be provided while still doubling the housing density of conventional city blocks. This condensation and the resultant square footage of living space has been fully set forth in the background discussion.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A multi-family dwelling configured as a double cruciform structure and positioned on a lot which is bounded on opposite sides by substantially parallel streets suitable for vehicle traffic, said dwelling comprising:

four generally L-shaped living units arranged into a first cruciform shape and having a first common wall which is substantially parallel to said street and a second common wall which is substantially perpendicular to said first common wall;

four generally L-shaped living units arranged into a second cruciform shape and having a first common wall which is substantially parallel to said street and a second common wall which is substantially perpendicular to said first common wall, said first common walls of said first and second cruciform shapes being substantially coplanar;

each of said L-shaped living units including an adjoining private atrium courtyard, a separate out building and a pair of security walls, the periphery of said private atrium courtyard being enclosed at least in part on two sides by the corresponding living unit, on a third side at least in part by one security wall in combination with said out building and on the fourth side at least in part by the other other security wall in combination with said out building;

a plurality of driveways, one corresponding to each out building and arranged to provide vehicle communication between said out building and one of said streets, for each cruciform shaped arrangement of four living units there are four driveways with two in communication with one street and the other two in communication with the opposite street; and a pair of spaced and substantially parallel pedestrian pathways, one pedestrian pathway being located at each end of the double cruciform structure and each pedestrian pathway being substantially perpendicular to said two streets.

2. The multi-family dwelling of claim 1 wherein each living unit is spaced back from the corresponding street which is vehicle communication with the out building of said living unit.

3. The multi-family dwelling of claim 1 wherein each cruciform arrangement of four living units includes a cruciform shaped raised roof section supported by a plurality of side walls, said plurality of side walls including windows for providing a skylighting effect, said first and second common walls extending through said corresponding roof section.

4. The multi-family dwelling of claim 1 wherein one security wall includes a lockable security gate.

5. The multi-family dwelling of claim 1 wherein said private atrium courtyard is generally rectangular.

6. The multi-family dwelling of claim 1 wherein said out building is a garage including a vehicle-sized opening into its corresponding driveway.

7. A multiple-family dwelling complex comprising:

a plot of land divided into four lots;

a main dwelling unit configured as a cruciform structure partitioned into four L-shaped individual units and positioned relative to said plot of land such that each lot is bounded on two adjacent sides by a different one of said individual units;

enclosing means associated with each lot and joined to a corresponding one of said individual units and defining therewith an interior and enclosed atrium courtyard on each lot for each individual unit; and said main dwelling unit further including a cruciform-shaped main roof and a cruciform-shaped raised roof portion positioned generally symmetrically to said main roof, said raised roof portion being designed and arranged to provide a skylighting effect to each of said four individual units.

8. The multiple-family dwelling complex of claim 7 wherein said raised roof portion is partitioned into four L-shaped skylighting units.

9. The multiple-family dwelling complex of claim 8 wherein said enclosing means includes a pair of privacy walls and an out building, said privacy walls connecting adjacent sides of said out building to opposite end of the corresponding individual unit.

* * * * *

UNITED STATES PATENT AND TRADEMARK OFFICE

CERTIFICATE OF CORRECTION

PATENT NO. : 4,800,692

DATED : January 31, 1989

INVENTOR(S) : Louis J. Jenn

It is certified that error appears in the above-identified patent and that said Letters Patent is hereby corrected as shown below:

On the title page, item [73]-

Please correct the name of the Assignee to read --Atrium Structures, Inc.--.

Signed and Sealed this

Twentieth Day of February, 1990

*Attest:*

JEFFREY M. SAMUELS

*Attesting Officer*

*Acting Commissioner of Patents and Trademarks*